United States Patent [19]

Bostic

[11] Patent Number: 4,744,378

[45] Date of Patent: May 17, 1988

[54] METHOD AND APPARATUS FOR SELECTING LIPSTICK SHADES

[75] Inventor: John S. Bostic, Strongsville, Ohio

[73] Assignee: 637073 Ontario Inc., Toronto, Canada

[21] Appl. No.: 945,196

[22] Filed: Dec. 18, 1986

Related U.S. Application Data

[63] Continuation of Ser. No. 503,878, Jun. 13, 1983, abandoned.

[51] Int. Cl.[4] ..... A45D 40/30

[52] U.S. Cl. ..... 132/88.5; 433/26

[58] Field of Search ..... 132/88.5, 88.1; 433/26

[56] References Cited

U.S. PATENT DOCUMENTS 785,992 3/1905 Whiteley ..... 433/26
1,518,608 12/1924 Short ..... 433/26
1,582,122 4/1926 Clapp ..... 433/26 X
1,990,630 2/1935 Bensel ..... 132/73
2,020,100 11/1935 Boyd ..... 132/73 UX
2,378,935 6/1945 Kraft ..... 132/73

FOREIGN PATENT DOCUMENTS 1011743 4/1952 France ..... 132/88.5

*Primary Examiner*—Gregory E. McNeill
*Attorney, Agent, or Firm*—Wayne D. Porter, Jr.

[57] ABSTRACT

A method for selecting a particular shade of lipstick that will brighten the appearance of one's teeth includes providing a plurality of tooth color samples in predetermined colors, selecting a plurality of lipstick shades, determining which of the lipstick shades best increases the apparent whiteness of selected tooth colors, and correlating a given tooth color sample with appropriate lipstick shades. Apparatus for carrying out the method includes a plurality of tooth color samples and a correlation chart for identifying the best lipstick shades that can be used with each tooth color.

8 Claims, 1 Drawing Sheet

METHOD AND APPARATUS FOR SELECTING LIPSTICK SHADES

This application is a continuation of Ser. No 06/503,878, filed June 13, 1983, now abandoned.

BACKGROUND OF THE INVENTION

1. Field of the Invention

The invention relates to a method and apparatus for selecting shades of lipstick that will brighten the apparent whiteness of one's teeth.

2. Description of the Prior Art

Known techniques for selecting shades of lipstick are believed to consist of nothing more than trial and error techniques whereby a user experiments with different shades of lipstick until a given color or colors is arrived at that suits the need of the particular user. Unfortunately, this trial and error technique can be rather expensive. It also does not insure that the user will select the most appropriate shade of lipstick. All that is certain to happen is the user will select a shade of lipstick that the user believes to be most appropriate, whereas in fact the selected shade or shades may not be most compatible with the user's appearance.

Even if the user should, by chance, select a shade of lipstick compatible with the user's appearance, it is entirely possible that circumstances may change such that a shade of lipstick once appropriate no longer may be appropriate. It is well recognized that one's skine tone, tooth color, and hair color may change over time due to various influences such as race, climate, diet habits, and general condition of health. Accordingly, a given cosmetic such as lipstick may be suitable for a particular individual at one time, but may not be suitable at a later time.

Although it is known to correlate the use of various types of cosmetic products such as soap, clarifying lotion, and so forth with the condition of one's skin, no such technique is known to exist with the respect to the selection of color-based cosmetics. More specifically, it is thought that no technique is known for the selection of lipstick shades that will best enhance the appearance of the user and that will eliminate the guesswork for selecting a shade of lipstick.

SUMMARY OF THE INVENTION

In response to the foregoing and other considerations, the present invention provides a new and improved and apparatus for selecting lipstick shades. It has been discovered that not only can the shade of lipstick used by an individual greatly change the appearance of the individual, but also that the apparent whiteness of the user's teeth can be increased or decreased by the shade of lipstick worn by the user. The invention makes use of this discovery by providing a plurality of tooth color samples, the samples being of a predetermined color and covering a representative range of most common tooth colors. The invention also involves selecting a plurality of lipstick shades for use in correlation with the predetermined tooth color samples. A preferred method of the invention involves determining which of the predetermined tooth colors are brightened best by the selected shades of lipstick, and further by providing a means for correlating the predetermined tooth colors and the selected shades of lipstick to reflect the results of determining which of the predetermined tooth colors are brightened best by the selected shades of lipstick. Further, the invention contemplates providing the tooth color samples with indicia by which the tooth color samples can be matched with corresponding tooth colors included as part of the means for correlating the predetermined tooth colors and the selected shade of lipstick.

Apparatus employed to carry out the invention includes a means for correlating the color of one's teeth and various shades of lipstick, the means for correlating providing a determination to the user that, for a given tooth color, various shades of lipstick are acceptable or unacceptable. In a preferred form of the invention, the means for correlating is in the form of an array having along one side indicia representative of various tooth colors and, along an adjacent side, indicia representative of various lipstick shades. It has been determined that nine tooth colors are most common and are employed with the array, and that 11 lipstick shades are most popular and these also are employed with the array.

The apparatus also includes tooth color samples for use by the user in comparing the samples with the color of the user's teeth. The tooth color samples are formed from chips of differently colored plastics material. Each of the chips includes a handle for manipulation by the user, and each handle includes indicia by which the associated tooth color sample can be matched with an appropriate portion of the array.

By use of the method and apparatus according to the invention, a user will be able to determine which shade of lipstick is most appropriate for that particular individual without any guesswork being required. If the color of the individual's teeth should change with time, various ones of the tooth color samples can be referred to in order to select different lipstick shades that will be most flattering. The foregoing, and other features and advantages of the invention, will be apparent from the remaining portion of the specification, including the drawings and the claims.

DESCRIPTION OF THE PREFERRED EMBODIMENT

Figure 1:
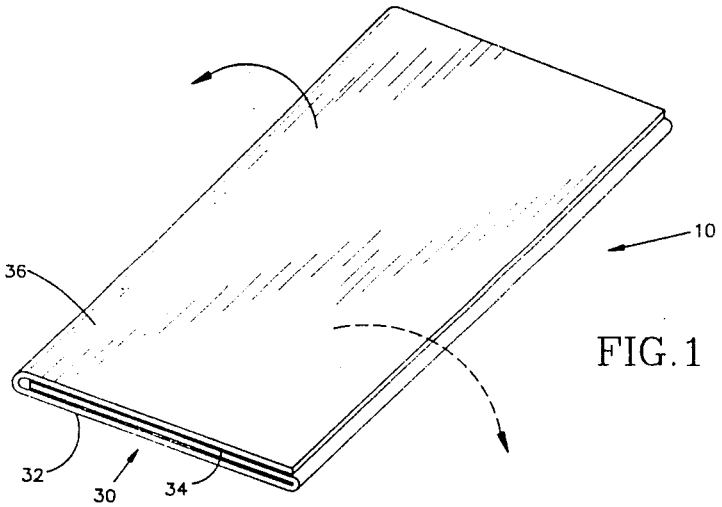
FIG. 1 is a perspective view of lipstick-selecting apparatus according to the invention in which a holder is shown in the closed position.
Figure 2:
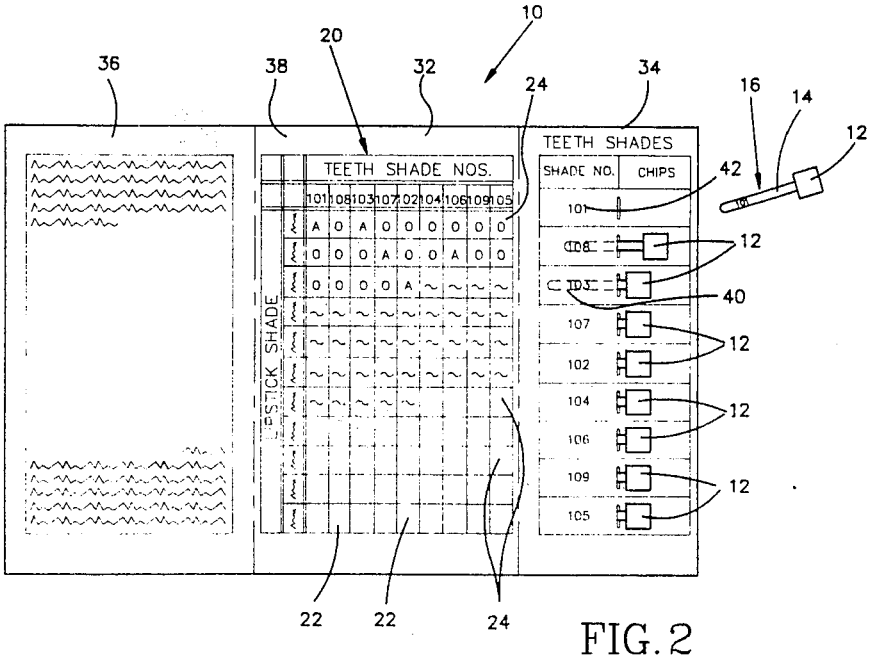
FIG. 2 is a view of the holder of FIG. 1 in the open position with a plurality of tooth color samples, an array, and descriptive material being displayed.

Referring to FIGS. 1 and 2, apparatus for selecting lipstick shades is shown generally by the reference numeral 10. The apparatus 10 includes a plurality of tooth color samples 12, each of the samples 12 including a small handle 14 for manipulation by the user. Each of the handles 14 includes indicia 16 by which the particular tooth color sample 12 attached to the handle 14 can be identified uniquely. Representative indicia 101, 102, 103, 104, 105, 106, 107, 108, 109 have been selected for use with the tooth color samples 12 illustrated in FIG. 2.

The apparatus 10 also includes a means for correlating the color of one's teeth and various shades of lipstick. The means for correlating is indicated generally by a chart bearing the reference numeral 20 and includes a rectangular array defined by columns 22 and rows 24. One side of the chart 20 is headed "TEETH SHADE NUMBERS" and each of the individual columns 22 is headed by a number such as 101, 102, and the like. The numbers placed at the head of the columns 22 correspond to the indicia 16 included with the handles 14. An adjacent side of the chart 20 is headed "LIPSTICK SHADE". Each of the rows 24 is headed by a name indicative of a particular lipstick shade such as red, brown, rose, plum, peach, pink, burgundy, and the like. In the example given, it has been found that there are 11 most popular lipstick shades, and there are nine most common tooth colors. These lipstick shades and tooth colors are represented by the chart 20 and the tooth color samples 12.

It has been found that particular tooth colors are brightened better by some lipstick shades then by other lipstick shades. It has been found that this increase in apparent brightness makes the user appear more attractive. Accordingly, for any given condition, the user should choose a shade of lipstick that will increase the apparent brightness of the user's teeth. In the chart 20, lipstick shades having the capability to apparently brighten a given tooth color the most are indicated by the letter "A," while lipstick shades not having such a capability are indicated by the letter "O." In the first row 24, for example, the chart 20 indicates that the particular shade of lipstick in the first row 24 would be best used with tooth colors closest to samples 101 and 103. If the user's teeth should be closer in color to one of the other tooth color samples 102–109, then the particular shade of lipstick in the first row 24 should not be worn by the user.

The apparatus 10 is carried by a book-like holder 30 having a rigid, generally planar portion 32, and overlying flaps 34, 36. As can be seen from an examination of FIG. 1, the flap 34 overlies the center portion 32, while the flap 36 overlies the flap 34.

The chart 20 carried by the center portion 32 is fitted within a clear plastic flap 38. This is to enable the chart 20 to be changed as popular lipstick shades may change from time-to-time. The tooth color samples 12 are fitted into slots 40 formed in the flap 34. Each of the slots 40 is covered and includes indicia 42 corresponding to the indicia 16. Accordingly, a particular tooth color sample 12 having identifying indicia "106" can be stored in the flap 34 by inserting the handle 14 into the slot bearing the indicia "106." By this technique, all of the samples 12 can be stored in the proper order.

The flap 36 includes information that will enable the user to correctly use the apparatus 10. In addition to background information about the apparatus 10, the flap 36 contains directions for use of the apparatus 10. These directions are substantially in the following form:

(1) Using a suitable light source such as a dressing table light, bathroom light, or lighted mirror, the tooth color samples 12 are matched to the user's upper front teeth.

(2) The tooth color sample 12 closest in color to the upper front teeth of the user is selected.

(3) Using the chart 20, the corresponding number for the tooth color sample 12 is located.

(4) Reading down the column 22 headed by the selected number, the user can quickly determine without any guesswork whatsoever, the shade or shades of lipstick that can be used to best enhance the appearance of the user.

Although the invention has been described in its preferred form with a certain degree of particularity, it will be understood that the present disclosure of the preferred embodiment has been made only by way of example and that various changes in the details of construction and combination and arrangement of parts may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A tooth and lipstick shade analyzing guide, comprising:

a tooth color panel having a plurality of tooth color samples for comparison with an individual's tooth color, each sample having an indicia associated therewith;

an anlyzing chart having multiple rows, each row having indicia assoicated therewith corresponding to a selected indicia of the tooth color samples, each row of said analyzing chart further having indicia acceptance or non-acceptance; and a lipstick shade display having multiple columns, each column containing at least one lipstick shade, the columns being juxtaposed to the acceptance or non-acceptance indicia in the analyzing chart.

2. The guide of claim 1, wherein the indicia associated with the tooth color samples are numbers.

3. The guide of claim 2, wherein the indicia associated with the rows of the analyzing chart are numbers.

4. The guide of claim 1, wherein the indicia indicating acceptance or non-acceptance are letters.

5. The guide of claim 1, wherein the tooth color samples are formed from chips of differently colored plastics material.

6. The guide of claim 5, wherein each of the chips include a handle for manipulation by the user.

7. The guide of claim 1, further including a holder having a generally planar portion to which the analyzing chart and the lipstick shade display are secured, the planar portion including a cover adapted to overlie the analyzing chart and the lipstick shade display.

8. The guide of claim 7, wherein the cover includes a plurality of slots, and the tooth color samples are fitted into the slots.

* * * * *